US008371054B2

(12) United States Patent
Casterline

(10) Patent No.: US 8,371,054 B2
(45) Date of Patent: Feb. 12, 2013

(54) ARTWORK PROTECTION DEVICE

(76) Inventor: Robert A. Casterline, Naples, FL (US)

( * ) Notice: Subject to any disclaimer, the term of this patent is extended or adjusted under 35 U.S.C. 154(b) by 168 days.

(21) Appl. No.: 12/967,274

(22) Filed: Dec. 14, 2010

(65) Prior Publication Data

US 2012/0144710 A1 Jun. 14, 2012

(51) Int. Cl.
*A47G 1/16* (2006.01)

(52) U.S. Cl. ..... 40/757; 248/475.1; 116/209

(58) Field of Classification Search ..... 40/662–669, 40/757, 759, 761, 771, 772, 797; 248/475.1, 248/482, 467, 497, 498, 495
See application file for complete search history.

(56) References Cited

U.S. PATENT DOCUMENTS

| | | | | | |
|---|---|---|---|---|---|
| 1,724,211 | A | | 8/1929 | MacQuarrie | |
| 2,026,708 | A | | 1/1936 | Rubin | |
| 3,254,438 | A | * | 6/1966 | Filary et al. | 248/467 |
| 4,211,022 | A | | 7/1980 | Angelakos | |
| 4,215,499 | A | | 8/1980 | Wilson | |
| 4,356,650 | A | | 11/1982 | Antonczyk et al. | |
| 4,709,495 | A | | 12/1987 | Buckwalter | |
| D298,221 | S | | 10/1988 | Popke | |
| 4,879,824 | A | | 11/1989 | Galloway | |
| 5,249,765 | A | * | 10/1993 | Garcia | 248/475.1 |
| D370,568 | S | | 6/1996 | Wynne | |
| 5,640,793 | A | | 6/1997 | Fischer | |
| 5,749,558 | A | * | 5/1998 | Wallo | 248/475.1 |
| 5,899,012 | A | | 5/1999 | Crum | |
| 5,961,090 | A | * | 10/1999 | Parkin | 248/475.1 |
| 6,070,847 | A | * | 6/2000 | Kirchner | 248/480 |
| 6,241,210 | B1 | * | 6/2001 | Brindisi | 248/476 |
| 6,279,257 | B1 | * | 8/2001 | Lemire | 40/757 |
| 6,286,802 | B1 | * | 9/2001 | Munson et al. | 248/475.1 |
| 6,286,803 | B1 | * | 9/2001 | Pellino et al. | 248/490 |
| D451,683 | S | | 12/2001 | Vincent | |
| 6,393,777 | B1 | * | 5/2002 | Renfrow | 52/202 |
| D458,064 | S | | 6/2002 | List, Jr. et al. | |
| 6,892,487 | B2 | * | 5/2005 | Keigley | 40/700 |
| 6,938,868 | B2 | * | 9/2005 | Pence | 248/354.3 |
| 6,962,016 | B1 | * | 11/2005 | Meyer | 40/757 |
| 7,237,349 | B2 | * | 7/2007 | Huang | 40/606.14 |
| 7,293,754 | B2 | * | 11/2007 | Gallien | 248/475.1 |
| 7,320,195 | B1 | * | 1/2008 | Kushner | 40/781 |
| 2003/0038222 | A1 | * | 2/2003 | Holmes | 248/475.1 |
| 2008/0107836 | A1 | | 5/2008 | Barnett | |

* cited by examiner

*Primary Examiner* — James Kramer
*Assistant Examiner* — Shin Kim
(74) *Attorney, Agent, or Firm* — The Livingston Firm; Edward M. Livingston, Esq.; Bryan L. Loeffler, Esq.

(57) ABSTRACT

An artwork protection device (2) having a set of brackets (1) that mount into a wall (18) which support a clear protective cover (14) over the front of a piece of hanging artwork (16). Each bracket has a footing (3) with a proximal end (4) and a distal end (5). The proximal end is attached to the wall using a screw, a bolt and a wall anchor and so forth. An extension (8) having a distal end (9) and a proximal end (10) that attaches to the distal end of the footing. The proximal end of the extension preferably has a recessed edge (12) that is placed through an aperture (13) located on a periphery of the protective cover. A cap (15) attaches to the proximal end of the extension, thereby locking the protective cover in place. The device allows a user to easily remove the protective cover and bracket extensions when the user wants to fully display the painting and to attach the caps directly to the footings to give an aesthetic appearance to the footings.

18 Claims, 3 Drawing Sheets

ARTWORK PROTECTION DEVICE

BACKGROUND OF THE INVENTION

This invention relates to two-dimensional hanging artwork, and more particularly, a device for mounting and spacing a protective cover in front of a hanging piece of artwork while allowing the artwork to be viewed through the protective cover.

Artwork, such as paintings, is commonly hung on walls and displayed in museums, galleries and people's homes. A common problem encountered when displaying artwork is protecting that artwork from damage caused by physical contact. For example, damage cause by individuals tripping into a piece of artwork, furniture tipping over into a piece of artwork, water damage from sprinkler systems and so forth. Another common problem encountered when displaying artwork is protecting the artwork from fading caused by sunlight. Conventional protection devices attempt to solve these problems, however such conventional devices are not removably attached to the artwork or the wall on which the artwork is hanging. Thus, conventional devices cannot be easily removed from a piece of artwork when a user wants to fully display the piece of artwork.

Therefore, a need exists for a device that will protect hanging artwork while still allowing the artwork to be viewed and enjoyed and a device that allows the user to easily remove the protective cover from the artwork when a user wants to fully display the piece of artwork.

The relevant prior art includes the following patent references:

| Patent/Serial No. | Inventor | Issue/Publication Date |
|---|---|---|
| 2008/0107836 | Barnett | May 8, 2008 |
| D458,064 | List, Jr. et al. | Jun. 4, 2002 |
| D451,683 | Vincent | Dec. 11, 2001 |
| 5,899,012 | Crum | May 4, 1999 |
| 5,640,793 | Fischer | Jun. 24, 1997 |
| D370,568 | Wynne | Jun. 11, 1996 |
| 4,879,824 | Galloway | Nov. 14, 1989 |
| 4,709,495 | Buckwalter | Dec. 01, 1987 |
| D298,221 | Popke | Oct. 25, 1988 |
| 4,356,650 | Antonczyk et al. | Nov. 2, 1982 |
| 4,215,499 | Wilson | Aug. 5, 1980 |
| 4,211,022 | Angelakos | Jul. 08, 1980 |
| 2,026,708 | Rubin | Jan. 07, 1936 |
| 1,724,211 | MacQuarrie | Aug. 13, 1929 |

SUMMARY OF THE INVENTION

The primary object of the present invention is to provide an artwork protection device that allows a user to easily mount and space a protective cover in front of a hanging piece of artwork.

Another object of the present invention is to provide an artwork protection device that protects artwork from damage caused by physical contact with the painting.

An even further object of the present invention is to provide an artwork protection device that protects artwork from damage caused by overexposure to light.

An even further object of the present invention is to provide an artwork protection device that allows artwork to be viewed and enjoyed while the protective cover is in place over the artwork.

Another object of the present invention is to provide an artwork protection device that allows the user to easily remove the protective cover from the artwork when a user wants to fully display the piece of artwork.

An even further object of the present invention is to provide an artwork protection device that is aesthetically pleasing while the protective cover is in place and aesthetically pleasing while the protective cover is not in place.

The present invention fulfills the above and other objects by providing an artwork protection device comprising a set of brackets that mount into a wall and support a clear protective cover over the front of a piece of hanging artwork. Each bracket comprises a footing that is attached to the wall using a screw, a nut and bolt, etc. An extension having a proximal end and a distal end attaches to the footing at the proximal end via an attachment means, such as a threaded connection. The proximal end of the extension has a recessed edge that is placed through an aperture located on a corner of the protective cover. The protective cover is then locked into place by attaching a cap to the end of the proximal end of the extension via an attachment means, such as a threaded connection and/or a locking means, which prevents easy access to the painting. Brackets are preferably located at each corner of the protective cover. The protective cover preferably has an ultra violet coating to protect the artwork from sunlight. The protective cover may also be bent along the top edge, thereby sealing off the space between the top of the protective cover and the wall and protecting the artwork from fire sprinklers and dust. The bent top edge provides the additional benefit of providing a surface for a user to place a level while installing the device. The device allows a user to easily remove the protective cover and extensions when the user wants to fully display the painting. For example, if a user is having a party or showing the user can remove the caps, protective cover and extensions. Then, the user can attach the caps directly to the footings via an attachment means, such as a threaded connection, to give a clean look to the footings.

Although the present invention is described herein as an "artwork protection device," it may also be used to protect anything hanging on a wall, such as flat screen televisions, sports jerseys, t-shirts, tapestries and so forth.

The above and other objects, features and advantages of the present invention should become even more readily apparent to those skilled in the art upon a reading of the following detailed description in conjunction with the drawings wherein there is shown and described illustrative embodiments of the invention.

BRIEF DESCRIPTION OF THE DRAWINGS

In the following detailed description, reference will be made to the attached drawings in which.

DESCRIPTION OF THE PREFERRED EMBODIMENTS

Figure 1:
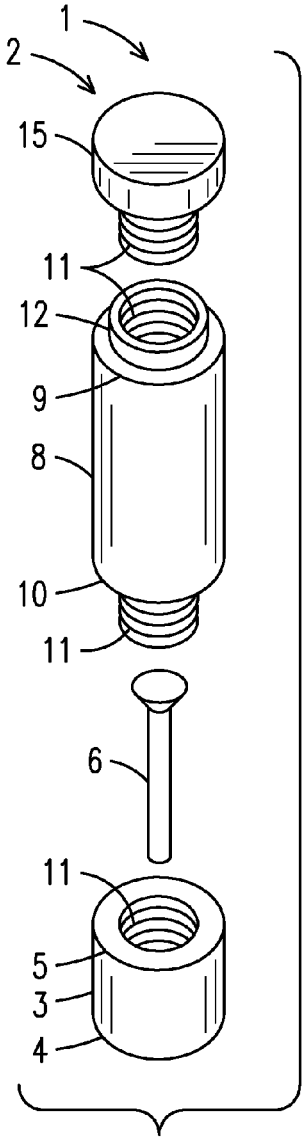
FIG. 1 is an exploded side perspective view of a bracket of the present invention.

For purposes of describing the preferred embodiment, the terminology used in reference to the numbered components in the drawings is as follows:

| | |
|---|---|
| 1. | bracket |
| 2. | artwork protection device |
| 3. | footing |
| 4. | proximal end of footing |
| 5. | distal end of footing |
| 6. | mounting means |
| 7. | aperture |
| 8. | extension |
| 9. | distal end of extension |
| 10. | proximal end of extension |
| 11. | attachment means |
| 12. | recessed edge |
| 13. | aperture |
| 14. | protective cover |
| 15. | cap |
| 16. | art work |
| 17. | top edge |
| 18. | wall |

Figure 5:
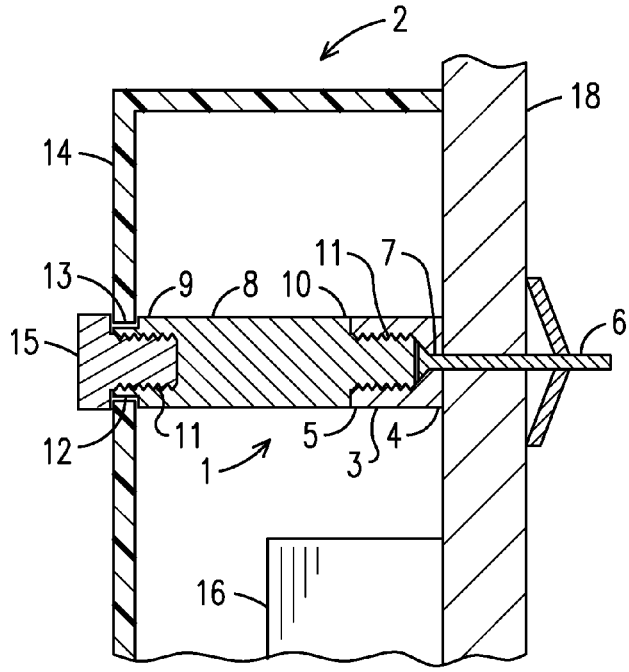
FIG. 5 is a cross-section view along line 5-5 of FIG. 4 showing the present invention having a protective cover secured in place over a piece of artwork.
Figure 2:
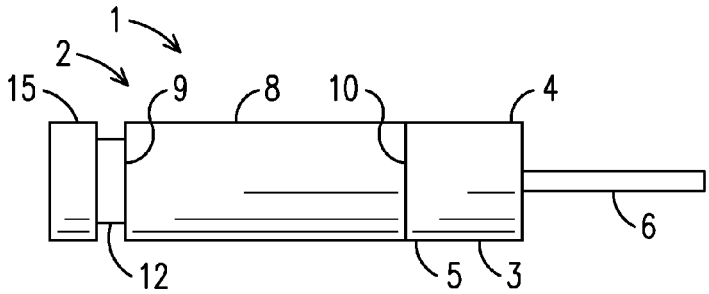
FIG. 2 is a side view of a bracket of the present invention.
Figure 3:
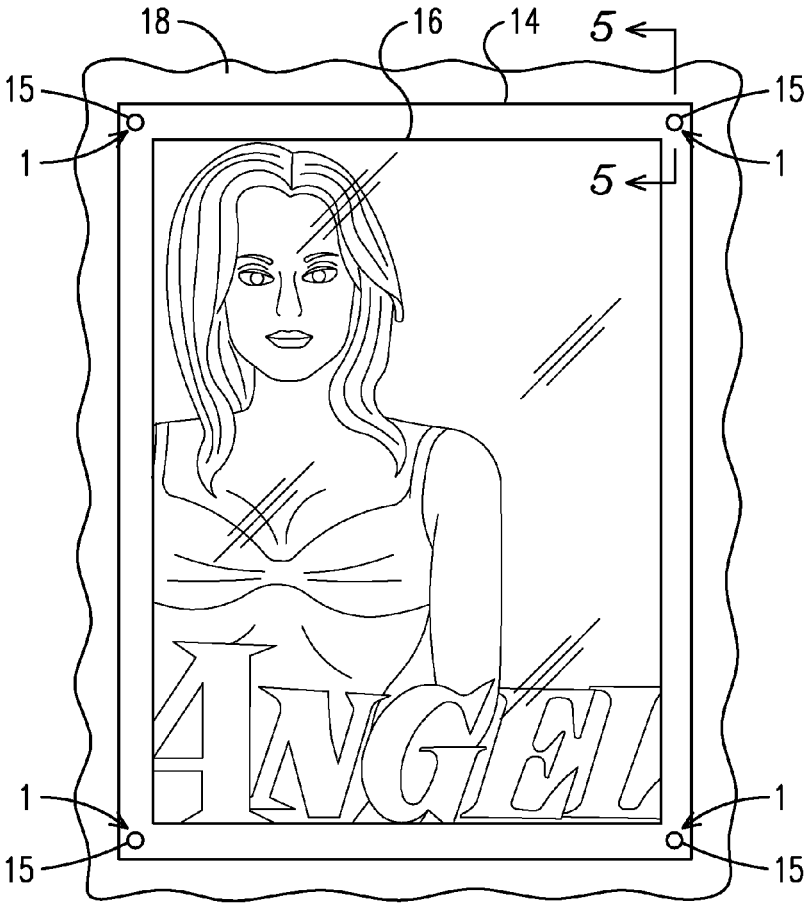
FIG. 3 is a front view of the present invention having a protective cover secured in place over a piece of artwork.
Figure 4:
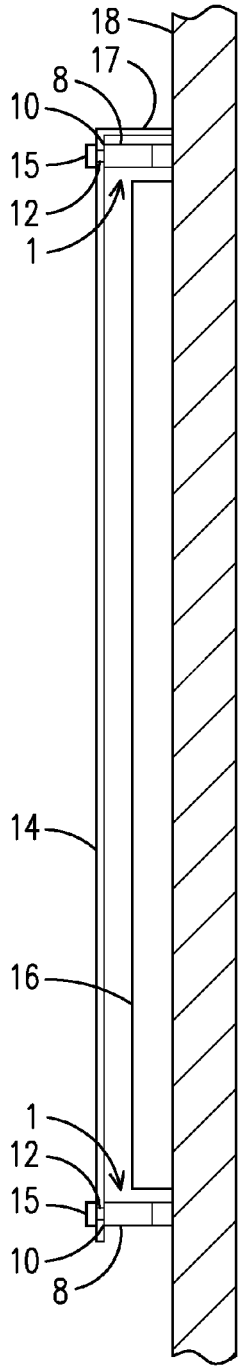
FIG. 4 is a side view of the present invention having a protective cover secured in place over a piece of artwork.

With reference to FIGS. 1 and 2, an exploded side perspective view of a bracket 1 of the present invention and a side view of a bracket 1 of the present invention, respectively, are shown. The brackets 1 allow a user to easily secure the protective cover 14 when the user wants to protect the artwork 16, as illustrated in FIGS. 3 and 4. The artwork protection device 2 comprises brackets 1, each having a footing 3 with a proximal end 4 and a distal end 5. The proximal end 4 is attached to a wall using a mounting means 6, such as a screw, a bolt and a wall anchor, and so forth. The mounting means 6 is placed through an aperture 7, as shown in FIG. 5. An extension 8 having a distal end 9 and a proximal end 10 that attaches to the distal end 5 of the footing 3 via an attachment means 11, such as a threaded connection. The proximal end 10 of the extension 8 preferably has a recessed edge 12 that is placed through an aperture 13 located on a corner of a protective cover 14, as shown in FIG. 5. A cap 15 attaches to the proximal end 10 of the extension 8 via an attachment means 11, such as a threaded connection and/or a locking means, which prevents easy access to the artwork.

With reference to FIGS. 3 and 4, a front view and a side view, respectively, of the present invention having a protective cover 14 secured in place over a piece of artwork 16 are shown. The proximal end 10 of the extension 8 has a recessed edge 12 that is placed through an aperture 13 located on a corner of the protective cover 14, as shown in FIG. 5. The protective cover 14 is then locked into place by attaching a cap 15 to the proximal end 10 of the extension 8 via an attachment means 11, such as a threaded connection and/or a locking means, which prevents easy access to the painting. The protective cover 14 preferably has an ultra violet coating to protect the artwork 16 from sunlight. The protective cover 14 may also be bent along the top edge 17, thereby sealing off the space between the top of the protective cover 14 and the wall 18 and protecting the artwork 16 from fire sprinklers, dust and so forth.

Figure 6:
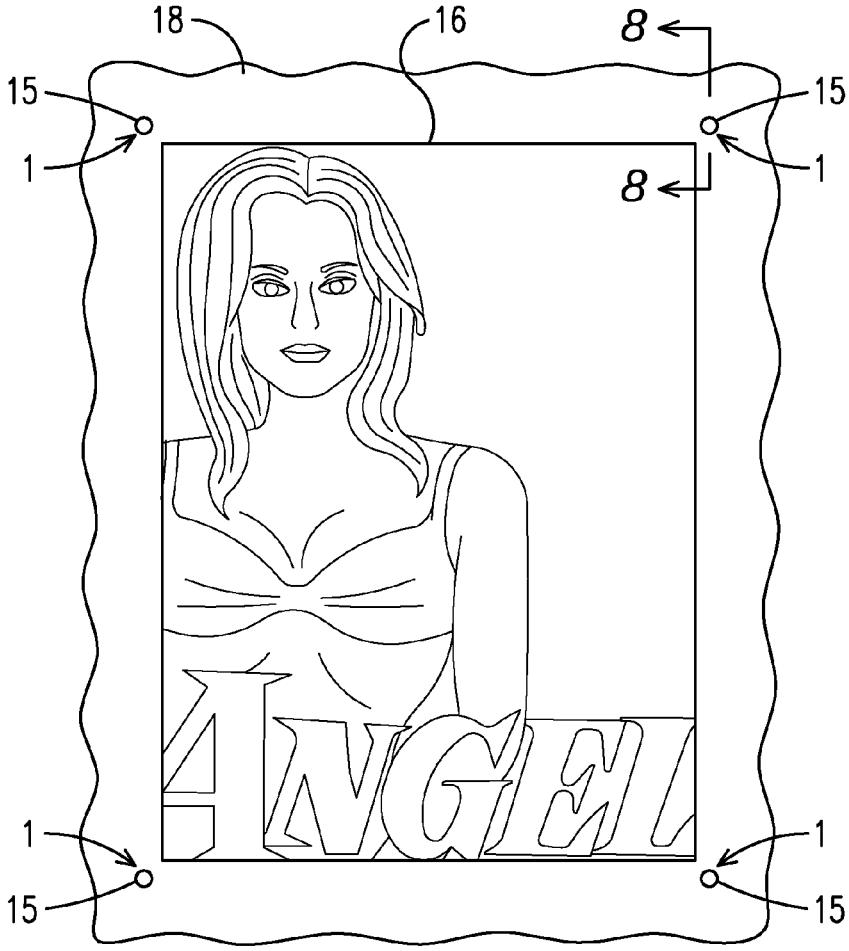
FIG. 6 is a front view of the present invention without a protective cover secured in place over a piece of artwork.

With reference to FIG. 5, a cross-section view along line 5-5 of FIG. 4 showing the present invention having a protective cover 14 secured in place over a piece of artwork 16 is shown. The artwork protection device 2 comprises brackets 1, each having a footing 3 with a proximal end 4 and a distal end 5. The proximal end 4 is attached to a wall using a mounting means 6, such as a screw, a bolt and a wall anchor and so forth. The mounting means 6 is placed through an aperture 7. An extension 8 having a distal end 9 and a proximal 10 end that attaches to the distal end 5 of the footing 3 via an attachment means 11, such as a threaded connection. The proximal end 10 of the extension 8 preferably has a recessed edge 12 that is placed through an aperture 13 located on a corner of a protective cover 14. A cap 15 attaches to the proximal end 10 of the extension 8 via an attachment means 11, such as a threaded connection and/or a locking means With reference to FIGS. 6 and 7, a front view and a side view, respectively, of the present invention without a protective cover 14 secured in place over a piece of artwork 16 are shown. The brackets 1 allow a user to easily remove the protective cover 14 when the user wants to fully display the artwork 16. The user can remove the caps 15, protective cover 14 and extensions 8. Then the user can attach the caps 15 directly to the footings 3 to give a clean look to the footings 3.

Figure 8:
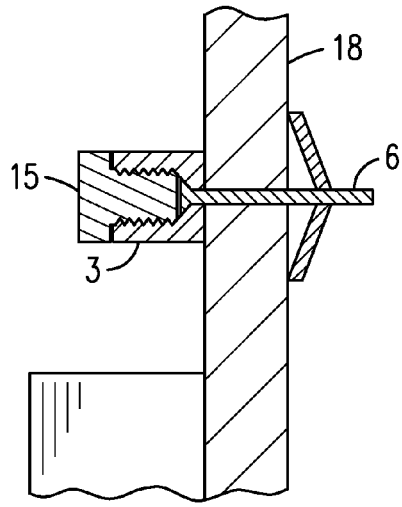
FIG. 8 is a cross-section view along line 8-8 of FIG. 7 showing the present invention without a protective cover secured in place over a piece of artwork.
Figure 7:
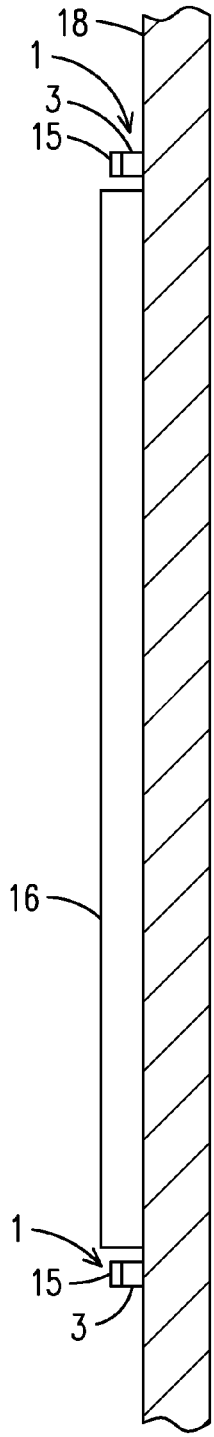
FIG. 7 is a side view of the present invention without a protective cover secured in place over a piece of artwork.

Finally with reference to FIG. 8 a cross-section view along line 8-8 of FIG. 7 showing the present invention without a protective cover secured in place over a piece of artwork is shown. The cap 15 has been directly attached to the footing 3 to give a clean look to the footing 3.

It is to be understood that while a preferred embodiment of the invention is illustrated, it is not to be limited to the specific form or arrangement of parts or use herein described and shown. It will be apparent to those skilled in the art that various changes may be made without departing from the scope of the invention and the invention is not considered to be limited to what is shown and described in the specification and drawings.

Having thus described my invention, I claim:

1. An artwork protection device for mounting a protective cover over a piece of artwork comprising:

at least one bracket;

said at least one bracket having a footing with a proximal end and a distal end;

said at least one bracket having an extension with a proximal end and a distal end, said proximal end of the extension being removably attachable to the distal end of the footing via a first attachment means;

said at least one bracket having a cap removably attachable to the distal end of the extension via a second attachment means;

an aperture located on the footing to allow a user to mount the footing to a surface using a mounting means that is placed through the aperture; and a protective cover having at least one aperture located on a periphery of the protective cover into which the at least one bracket is removably attachable by sandwiching a portion of the protective cover between the distal end of the extension and the cap.

2. The artwork protection device of claim 1 wherein:

said first attachment means is a threaded connection; and said second attachment means is a threaded connection.

3. The artwork protection device of claim 1 wherein:

said bracket further comprises a recessed edge located on the distal end of the extension.

4. The artwork protection device of claim 1 wherein:

said at least one bracket further comprises a recessed edge located on the cap.

5. The artwork protection device of claim 3 further comprising:

a protective cover having at least one aperture located on a periphery of the protective cover into which the at least one bracket is removably attachable by placing the recessed edge located on the distal end of the extension through the at least one aperture, thereby sandwiching a portion of the protective cover between the distal end of the extension and the cap.

6. The artwork protection device of claim 4 further comprising:

a protective cover having at least one aperture located on a periphery of the protective cover into which the at least one bracket is removably attachable by placing the recessed edge located on the cap through the at least one aperture, thereby sandwiching a portion of the protective cover between the distal end of the extension and the cap.

7. The artwork protection device of claim 5 wherein:

said protective cover is bent along an upper edge of the protective cover.

8. The artwork protection device of claim 5 wherein:

said protective cover has a protective coating to protect a painting from over exposure to light.

9. The artwork protection device of claim 6 wherein:

said protective cover is bent along an upper edge of the protective cover.

10. The artwork protection device of claim 6 wherein:

said protective cover has a protective coating to protect a painting from over exposure to light.

11. The artwork protection device of claim 7 wherein:

said protective cover is bent along an upper edge of the protective cover.

12. The artwork protection device of claim 7 wherein:

said protective cover has a protective coating to protect a painting from over exposure to light.

13. The artwork protection device of claim 1 wherein:

said cap is removably attachable to the distal end of the extension via a locking means.

14. An artwork protection device for mounting a protective cover over a piece of artwork comprising:

at least one bracket;

said at least one bracket having a footing with a proximal end and a distal end;

said at least one bracket having an extension with a proximal end and a distal end, said proximal end of the extension being removably attachable to the distal end of the footing via a first attachment means;

said at least one bracket having a cap removably attachable to the distal end of the extension via a second attachment means;

said at least one bracket further comprises a recessed edge located between the distal end of the extension and the cap;

an aperture located on the footing to allow a user to mount the footing to a surface using a mounting means that is placed through the aperture; and a protective cover having at least one aperture located on a periphery of the protective cover into which the at least one bracket is removably attachable by placing the recessed edge through the at least one aperture, thereby sandwiching a portion of the protective cover between the distal end of the extension and the cap.

15. The artwork protection device of claim 14 wherein:

said first attachment means is a threaded connection; and said second attachment means is a threaded connection.

16. The artwork protection device of claim 14 wherein:

said protective cover is bent along an upper edge of the protective cover.

17. The artwork protection device of claim 14 wherein:

said protective cover has a protective coating to protect a painting from over exposure to light.

18. The artwork protection device of claim 14 wherein:

said cap is removably attachable to the distal end of the extension via a locking means.

* * * * *